United States Patent [19]

Stein

[11] Patent Number: 4,576,291

[45] Date of Patent: Mar. 18, 1986

[54] GRAVITY FEED MERCHANDISE DISPLAY FIXTURE

[75] Inventor: Robert Stein, Sharon, Mass.

[73] Assignee: Vining Broom Company, Inc., Springfield, Ohio

[21] Appl. No.: 485,961

[22] Filed: Apr. 18, 1983

[51] Int. Cl.[4] ..... A47F 7/00

[52] U.S. Cl. ..... 211/49.1; 211/59.1; 211/65

[58] Field of Search ..... 211/60 T, 60 R, 65, 211/66, 87, 88, 57.1, 59.1, 49 R, 49 D, 106; D6/186, 126, 188, 114, 189, 125; 248/220.3, 220.4, 221.1, 221.2; 312/206, 207, 117, 10

[56] References Cited

U.S. PATENT DOCUMENTS

| | | | |
|---|---|---|---|
| D. 215,512 | 9/1969 | Manelli | D6/125 |
| 341,693 | 5/1886 | Roeseler | 211/65 |
| 493,896 | 3/1893 | Pierce | 211/65 |
| 495,789 | 4/1893 | Denniston | 211/65 |
| 1,138,995 | 5/1915 | Stewart | 211/65 |
| 2,623,642 | 12/1952 | Looney | 211/65 |
| 2,723,026 | 11/1955 | Paige | 211/65 |
| 2,802,576 | 8/1957 | Kelling | 211/59.1 |
| 2,988,229 | 6/1961 | Cohen et al. | 211/13 |
| 4,386,710 | 6/1983 | Dauman | 211/49 D |

FOREIGN PATENT DOCUMENTS

| | | | |
|---|---|---|---|
| 2308335 | 11/1976 | France | 211/57.1 |
| 248924 | 3/1926 | United Kingdom | 211/89 |

*Primary Examiner*—Robert W. Gibson, Jr.
*Attorney, Agent, or Firm*—Jerome P. Bloom

[57] ABSTRACT

New and improved gravity feed merchandise display fixture is provided and comprises means forming respective stick and peg merchandise storage and display compartments which alternate as seen from the front of the fixture. Means are provided in the peg merchandise storage and display compartments to insure that peg merchandise contained therein is gravity-fed to the forward-most, and thus most sales-conducive, positions in the compartments; and means are provided in the stick merchandise storage and display compartments to insure particularly attractive, and thus sales-conducive, display of the stick merchandise. The respective stick and peg merchandise compartments are formed by intersecting support frames which are interfitted without fastening means to thus render the assembly of the fixture particularly convenient; and the fixture makes highly efficient utilization of the merchandise display floor space required therefor.

12 Claims, 6 Drawing Figures

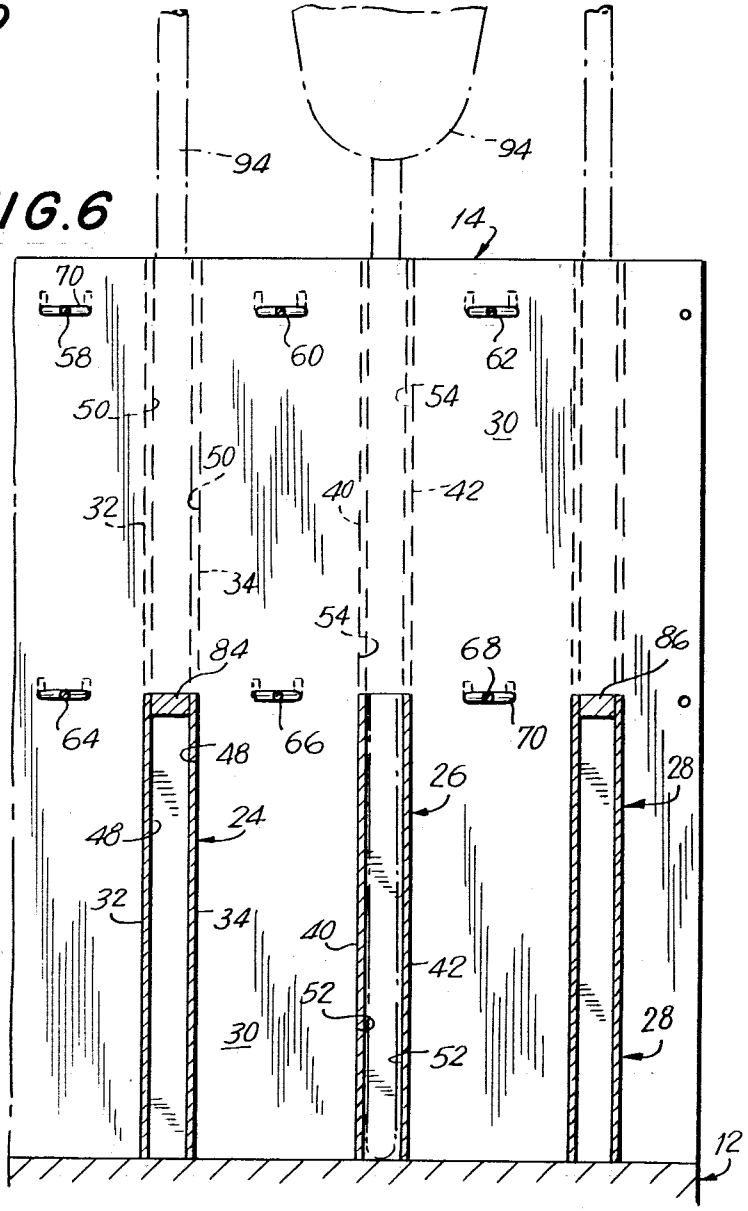
FIG.6
FIG.5
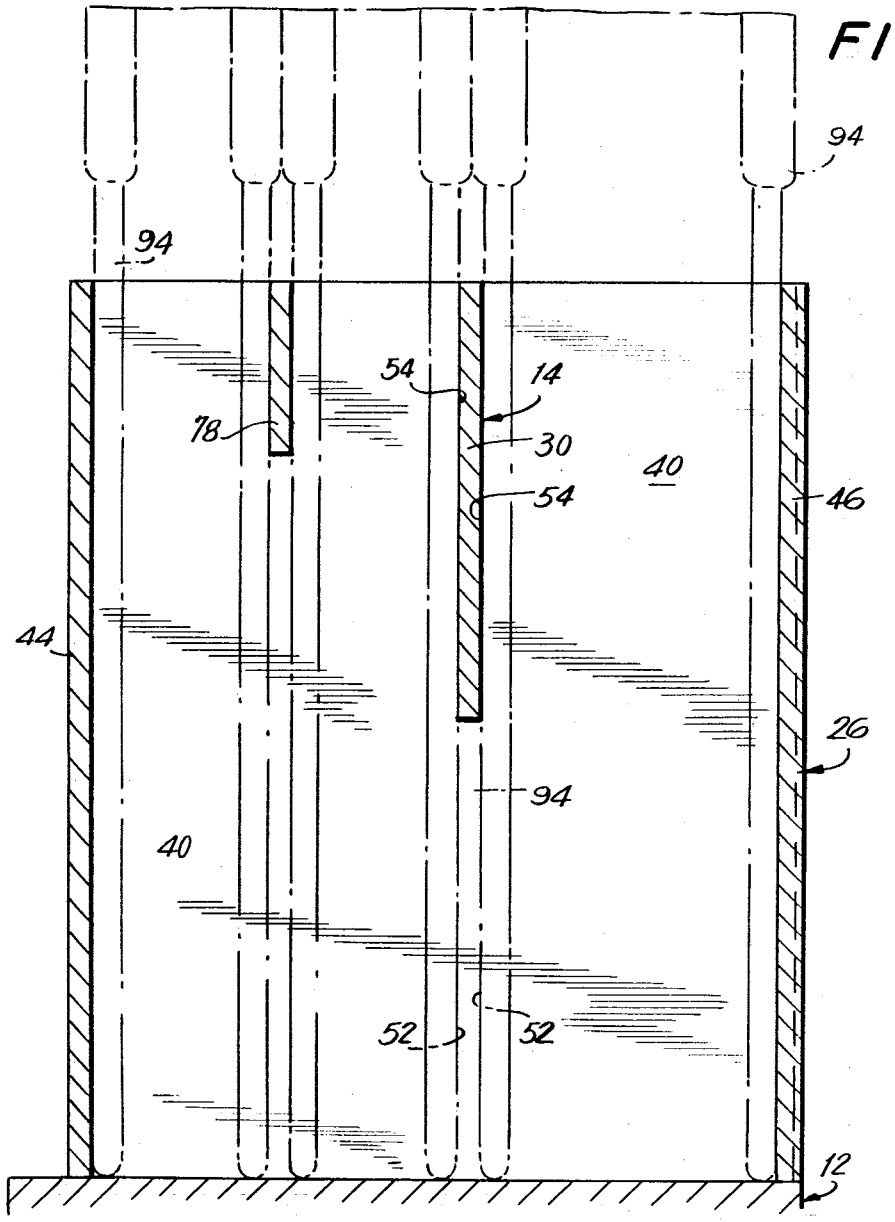

GRAVITY FEED MERCHANDISE DISPLAY FIXTURE

BACKGROUND OF THE INVENTION

1. Field of the Invention

This invention relates to a new and improved gravity feed merchandise display fixture.

2. Description of the Prior Art

Although a wide variety of merchandise display racks are, of course, known in the prior art, none are known to be configured and/or operable in the manners of the merchandise display rack of this invention, or to provide the significant advantages as are provided by the latter.

More specifically, W. H. Speiser U.S. Pat. No. 838,473 issued Dec. 11, 1906 discloses a broom rack comprising a plurality of support members which include support slots, notches and screw eyes for the staggered and oppositely oriented support of a plurality of differently sized brooms from the same rack. This rack is restricted to the display of brooms; and does not, in any event, make particularly efficient merchandise display utilization of the display space required by the rack.

A. Marko U.S. Pat. No. 922,008 issued May 18, 1909 discloses a broom holder comprising spaced bracket arms and broom handle retainers for the support of a plurality of brooms. This broom holder is restricted to the display of brooms or shovels or the like, is not free-standing in that the same requires mounting from a vertical support such as a wall or post, and again does not make particularly efficient merchandise display utilization of the display space required by the holder.

T. C. Dell U.S. Pat. No. 1,208,923 issued Dec. 19, 1916 discloses a collapsible broom rack comprising spaced, upper and lower horizontal support members having spaced projections for the support of brooms therebetween. This rack is again restricted to the display of brooms or like long handled devices, does not make particularly efficient merchandise display utilization of the display space required by the rack and, due to the relatively sharp nature of some of the support projections which are in the nature of pins, can present a safety hazard to the consumer.

J. A. Merkle U.S. Pat. No. 1,841,753 issued Jan. 9, 1932 discloses a collapsible display rack for brooms and other long handled devices which comprises vertically spaced, apertured support strips extending from a support panel. This rack is also restricted to the display of brooms and other long handled devices, and makes particularly poor merchandise display utilization of the display space required for the rack.

C. H. Brown U.S. Pat. No. 2,423,292 issued July 1, 1947 discloses a portable mop or broom rack which is designed for the storage, rather than merchandising display, of brooms or wet mops or the like and is, as such, of particularly limited capacity and bears little structural or functional relationship to the merchandise display fixture of this invention.

R. E. Paige U.S. Pat. No. 2,723,026 issued Nov. 8, 1955 discloses a combined shipping carton and display rack for mops and similar long-handled goods, only; and which amounts to little more than a corrugated paper board box which may be cut and re-assembled upon receipt to form a somewhat primitive display rack of marginal stability and particularly limited practical merchandise display utility.

N. M. Richardson U.S. Pat. No. 2,904,188 issued Sept. 15, 1959 discloses a utility rack which, although capable of displaying a variety of brooms and brushes and mops and the like, is of particularly convoluted design and construction in requiring pluralities of support members with attendant notches, grooves, protuberances, openings, spring members, hooks, and eye members and the like, all contributing to render the same decidedly impractical for use in accordance with contemporary merchandise display techniques.

Pablo Navarro U.S. Pat. No. 3,633,860 issued Jan. 11, 1972 discloses a spring-actuated mounting bracket, per se, for the handles of mops and brooms and the like which is adapted to the home or institutional storage, rather than display, of those items as by the wall-mounted use of the bracket in a mop and/or broom storage closet.

A more relevant and contemporary prior art device is the cleaning aids display fixture as manufactured by Hartstone Construction Company of Roxbury, Massachusetts, and currently in relatively widespread use in the retailing of such merchandise. This prior art fixture comprises a generally vertically oriented front peg board from which relatively long exposed pegs extend horizontally and forwardly of the fixture for the support and display therefrom of what is generally termed "peg merchandise," i.e. blister or otherwise packaged brushes, sponges, mop-heads and the like; and one or more generally horizontally oriented panels disposed behind the front peg board panel and comprising spaced slots for the upstanding support and display therefrom of what is generally termed "stick merchandise," i.e. mops and brooms and like long handled articles. The disadvantages of this prior art fixture have now been determined in accordance with the teachings of this invention to include relatively limited capacity for both the stick and peg merchandise with attendant inconvenient need for frequent replenishment of the same to prevent the fixture from presenting an empty appearance which is not particularly conducive to sales and to, in any event, insure that all of the merchandise is continually on display and readily available for sale to the consumer; some measure of risk of injury to, or damage to the clothing of, the consumer and/or accompanying small children by the protruding pegs which have been exposed by the removal of all merchandise therefrom for sale; and relatively poor merchandise display utilization of the ever increasingly expensive display floor space required by the fixture. In addition, this fixture requires fastening means to join the respective components thereof thereby complicating the in situ assembly and disassembly thereof.

Significantly, and in addition to the above-described structural and functional deficiencies of the specified prior art devices, none of the same include provision for the gravity feed of the peg merchandise to the forefront of the display fixture for the automatic replenishment of the peg merchandise at that sales-conducive location attendant peg merchandise removal for sale from the display fixture.

OBJECTS OF THE INVENTION

It is, accordingly, an object of this invention to provide a new and improved merchandise display fixture.

Another object of this invention is the provision of a merchandise display fixture as above which operates to display particularly wide varieties of both stick and peg merchandise in the same merchandise display space.

Another object of this invention is the provision of a merchandise display fixture as above including provision for the gravity feed of the peg merchandise to the forefront of the display fixture for the automatic replenishment of the peg merchandise at that sales-conducive location attendant peg merchandise removal for sale from the display fixture.

Another object of this invention is the provision of a merchandise display fixture as above which makes particularly efficient merchandise display utilization of the display floor space required by the fixture.

Another object of this invention is the provision of a merchandise display fixture as above which is of significantly increased merchandise capacity as compared to contemporary merchandise display fixtures of the prior art to thus negate the need for frequent and inconvenient merchandise replenishment.

Another object of this invention is the provision of a merchandise display fixture as above which is configured and operable to present a well-stocked and sales-conducive appearance despite the removal therefrom for sale of a large portion of the merchandise displayed thereon.

Another object of this invention is the provision of a merchandise display fixture as above wherein the peg merchandise support pegs are shielded within the display fixture and do not protrude therefrom thereby minimizing the risks of injury to the consumer and/or damage to the consumer's clothing.

Another object of this invention is the provision of a merchandise display fixture as above of particularly stable configuration which is highly resistant to being tipped over.

Another object of this invention is the provision of a merchandise display fixture as above which operates to display the merchandise in a particularly attractive and sales-conducive manner.

Another object of this invention is the provision of a merchandise display fixture as above which is of relatively simple, economical and durable construction, and which requires only readily available materials of proven dependability in the fabrication thereof.

A further object of this invention is the provision of a merchandise display fixture as above which requires no fastening means for the simple assembly of the display fixture components, whereby the assembly and disassembly of the display fixture in situ, and the shipping of the display fixture in component rather than completed form, are each rendered more convenient.

A further object of this invention is the provision of a merchandise display fixture as above which is particularly adapted for construction in modular or sectional form to provide for significant versatility of display fixture application.

SUMMARY OF THE INVENTION

The new and improved merchandise display fixture of the invention operates to store and display relatively large quantities of stick and peg merchandise in particularly attractive and sales-conducive manner with a high degree of efficiency of display space utilization. The terms "stick" and "peg" merchandise as used herein refer respectively to long handled articles such as brooms, mops and the like and to smaller articles, usually packages, displayed by being hung from pegs. The merchandise display fixture comprises means forming a plurality of stick merchandise storage and display compartments, and means cooperating therewith to form a plurality of peg merchandise storage and display compartments which alternate with the stick merchandise compartments as seen from the front of the fixture. The respective compartments are formed by stick and peg merchandise support frames which intersect to form a lattice-like structure which, through use of complementally shaped and sized slots at the respective frame intersections, may be assembled without fastening means. The stick merchandise support frames comprise generally vertically oriented box-like assemblies having open tops into which the stick merchandise my be inserted for storage and display. The peg merchandise support frame comprises a generally vertically oriented member which extends perpendicularly of the stick merchandise support frames and cooperates with the respective side walls thereof to form the peg merchandise storage and display compartments therebetween. Support pegs extend forwardly and downwardly from the peg merchandise support frame toward the front of the display fixture through the respective peg merchandise storage and display compartments, and do not extend without the latter. Peg merchandise supported on the support peg means will slide to the forward-most position thereon in turn under the influence of gravity. Generally vertical and horizontal stick merchandise stop means are provided in the stick merchandise support frames for attractive stick merchandise display.

DESCRIPTION OF THE DRAWINGS

The above and other objects and significant advantages of this invention are believed made clear by the following detailed description thereof taken in conjunction with the accompanying drawings wherein:

FIG. 5 is a vertical cross section taken along line 5—5 of FIG. 2; and FIG. 6 is a horizontal cross section taken along line 6—6 of FIG. 2.

DETAILED DESCRIPTION OF THE INVENTION

Figure 1:
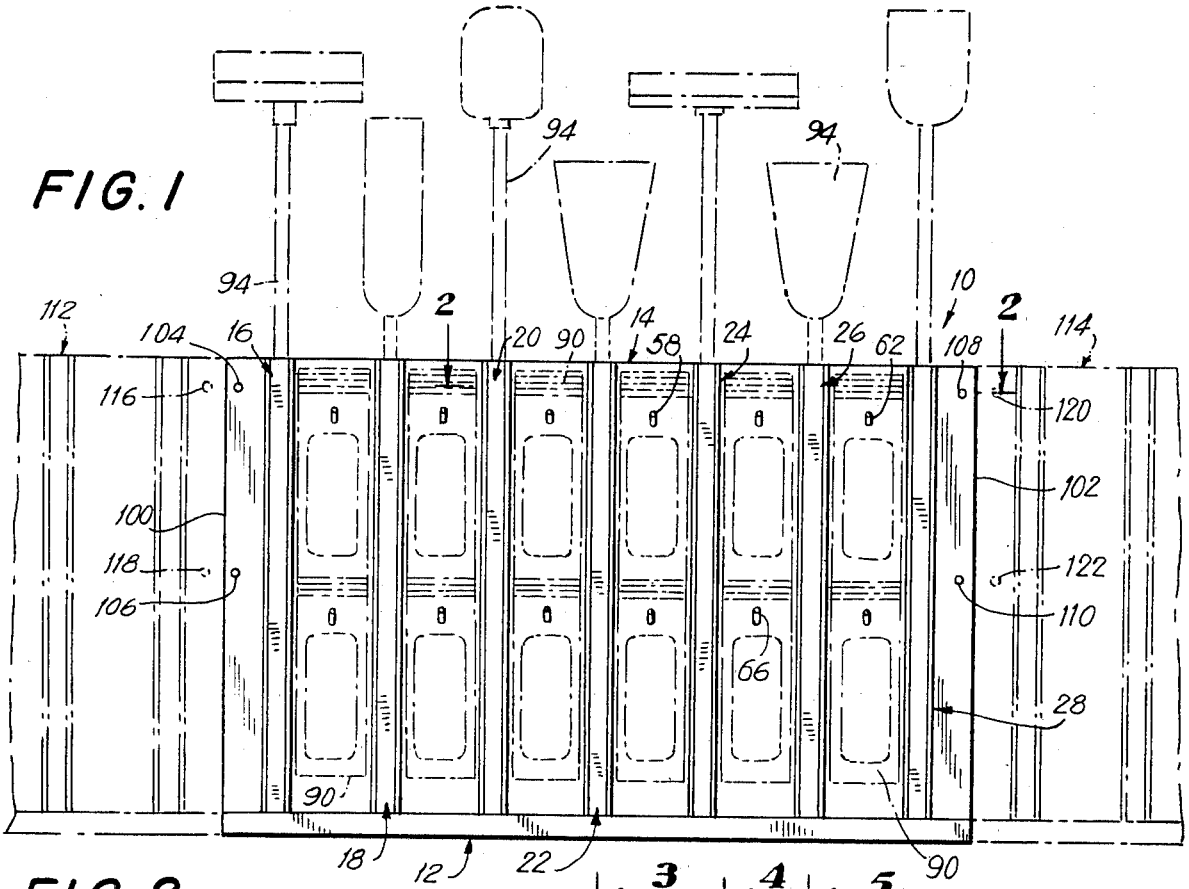
FIG. 1 is a front elevational view of a new and improved merchandise display fixture constructed and operative in accordance with the teachings of this invention, and includes the depiction in phantom of typical merchandise for display from the fixture.
Figure 2:
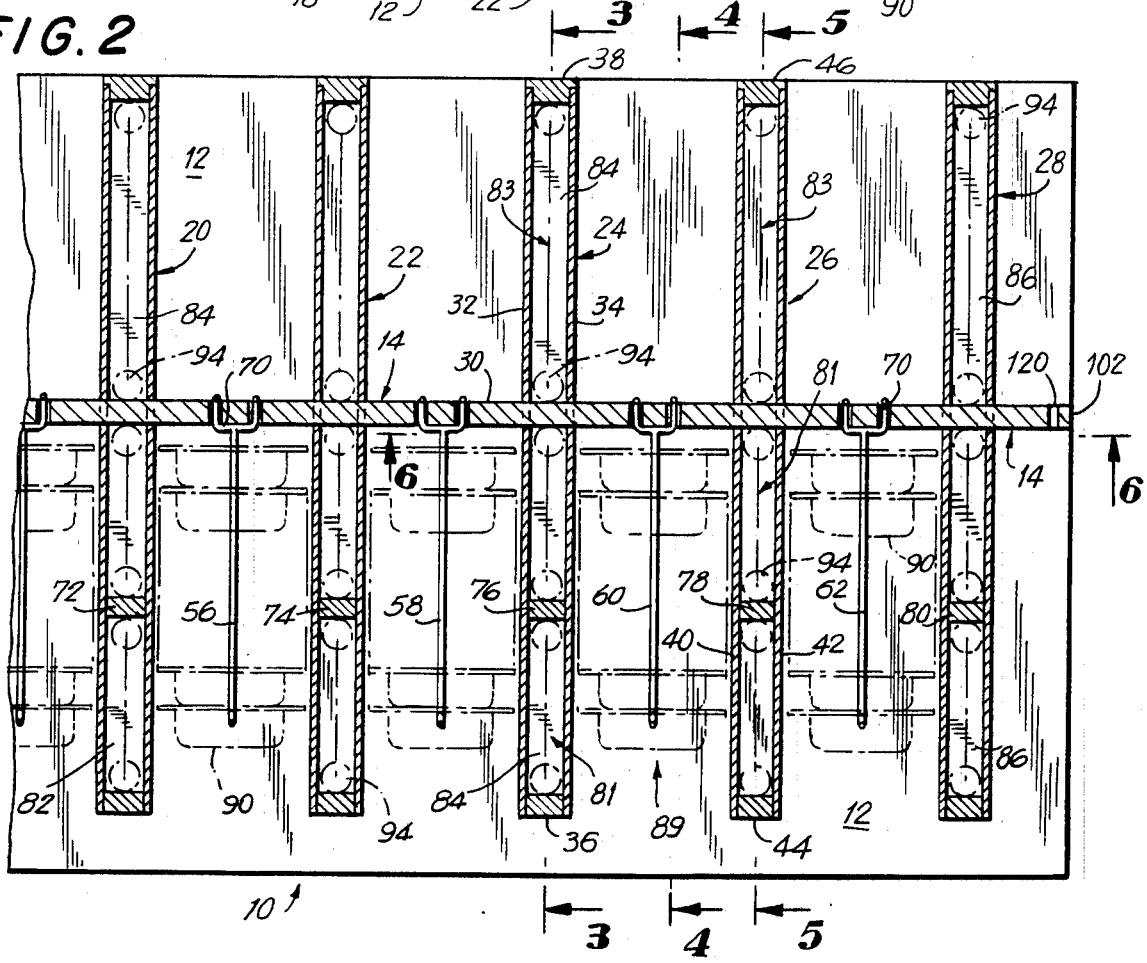
FIG. 2 is a horizontal cross section taken along line 2—2 of FIG. 1.

Referring now to FIGS. 1 and 2 of the drawings, a new and improved, gravity feed merchandise display fixture constructed and operable in accordance with the teachings of this invention is indicated generally at 10; and comprises a flat, generally rectangular base member 12 from which are carried a generally longitudinally extending central peg merchandise support member or frame 14, and a plurality of intersecting, spaced generally transversely extending stick merchandise support members or frames as indicated respectively at 16, 18, 20, 22, 24, 26 and 28 in FIG. 1. As best seen in FIG. 2, the peg merchandise support frame preferably comprises a single upstanding sheet 30 of any appropriately durable and inexpensive material such as plywood or plastic sheet; while the respective stick merchandise support frames each comprise an open ended box-like structure of like materials which includes spaced upstanding side walls and coextensive, opposed upstanding end caps as indicated at 32, 34, 36 and 38 for stick merchandise support frame 24, and at 40, 42, 44 and 46 for stick merchandise support frame 26. The respective side walls 32 and 34, and 40 and 42, are preferably fitted as shown into grooves provided therefor in the end caps 38 and 46, and simply abut the sides of the end caps 36 and 44 as shown to be flush therewith; and the side walls and end caps are attached in any appropriate and inexpensive manner at the respective junctures thereof, for example by glueing, to effect the sturdy assembly of the respective stick merchandise support frames.

The respective peg and stick merchandise support frames are interfitted through the simple and inexpensive expedient of complemental slots to in essence form a lattice-like structure which may be readily assembled and/or disassembled in situ without fastening means to significant advantage regarding both convenience of shipping and assembly of the display fixture, and regarding the provision of substantial structural integrity for the assembled fixture.

Figure 3:
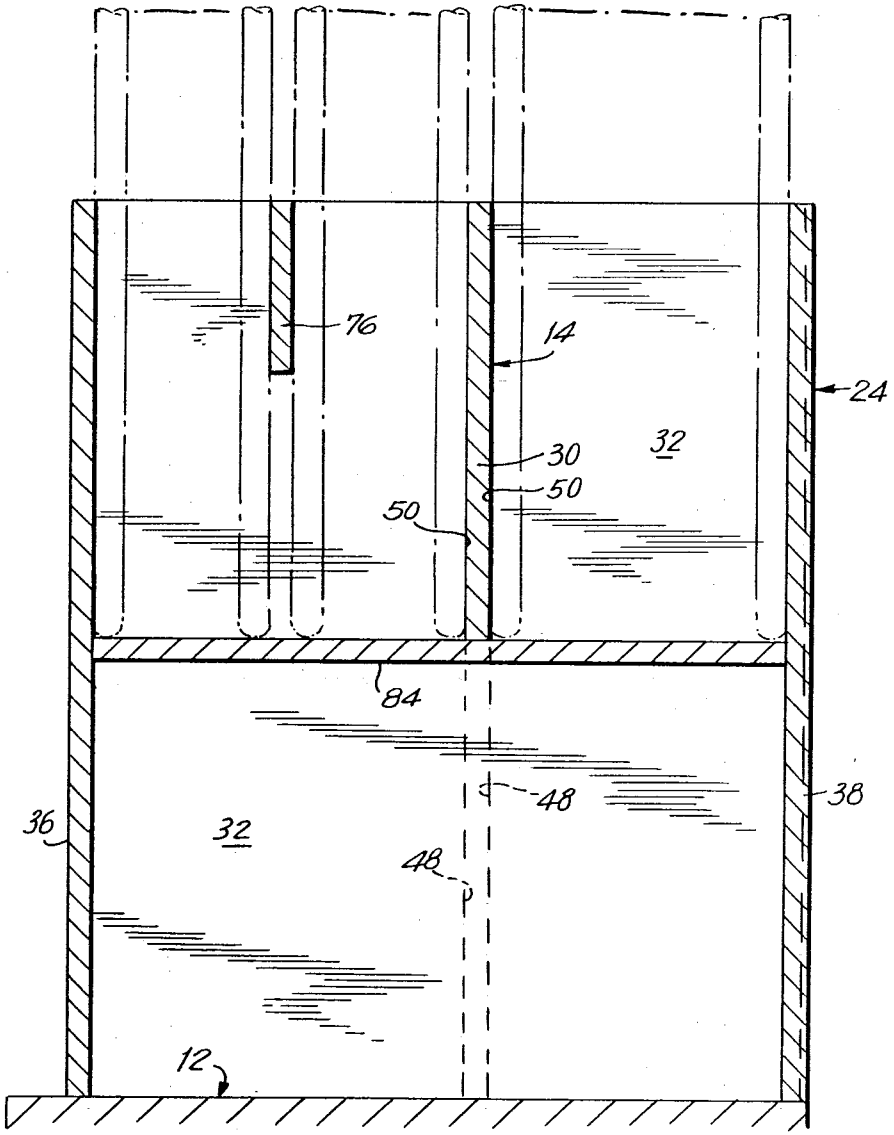
FIG. 3 is a vertical cross section taken along line 3—3 in FIG. 2.

More specifically, and as made clear by FIGS. 2, 3 and 6, it will be seen that the peg merchandise support frame 14 is vertically slotted to the width of the stick merchandise support frame 24 from the bottom of the former upwardly to approximately its midpoint as indicated at 48 in FIGS. 3 and 6 at the location where support frame 24 intersects support frame 14. The support frame 24 is complementally vertically slotted to the width of the support frame 14 from the top of the support frame 24 downwardly to approximately its midpoint at that same location as indicated at 50 in FIGS. 3 and 6. Thus, the lower portion of stick merchandise support frame 24 will fit snugly into the slot 48 in the lower portion of peg merchandise support frame 14, while the upper portion of support frame 14 will fit snugly into the slot 50 in the upper portion of support frame 24.

In like manner, the peg merchandise support frame 14 is vertically slotted to the width of stick merchandise support frame 26 from the bottom of the former upwardly to approximately its midpoint as indicated at 52 in FIGS. 5 and 6 at the location where support frame 26 intersects support frame 14; while the support frame 26 is complementally vertically slotted to the width of support frame 14 from the top of support frame 26 downwardly to approximately its midpoint at that same location as indicated at 54 in FIGS. 5 and 6. Thus, the lower portion of stick merchandise support frame 26 will fit snugly into the slot 52 in the lower portion of the peg merchandise support frame 14, while the upper portion of support frame 14 will fit snugly into the slot 54 in the upper portion of support frame 26. Although not specifically illustrated or described, it may be understood that the interfitting relationships between peg merchandise support frame 14 and the remaining stick merchandise support frames 16, 18, 20, 22 and 28 is exactly the same as that described in detail for peg merchandise support frame 14 and stick merchandise support frames 24 and 26.

With the respective peg merchandise support frame 14 and stick merchandise support frames 16, 18, 20, 22, 24, 26 and 28 configured as described, it will be clear that assembly of those frames may be readily and conveniently effected in situ by placement of the base 12 as desired on the merchandise display floor; placement of the respective stick merchandise support frames 16, 18, 20, 22, 24 and 26 on the base 12 by simply standing the same thereon at the appropriately spaced locations, and thereafter appropriately positioning the peg merchandise support frame 14 over the thusly located stick merchandise support frames and moving the former downwardly to interfit therewith as described into contact with the base 12 to complete fixture assembly. The particularly sturdy nature of the resultant fixture assembly, coupled with the fact that the weight of the peg merchandise support frame 14, and of the merchandise which is to be displayed therefrom as described in detail hereinbelow, will act to retain the fixture assembled, advantageously renders unnecessary any other attachment, as by fastening means, of the respective peg and stick merchandise support frames; while the overall weight of the fixture and of the merchandise to be displayed therefrom will act to retain the same as positioned on the base 12 to thus render any display fixture-base attachment means equally unnecessary.

Dis-assembly of the respective peg and stick merchandise support frames, as for periodic thorough cleaning or removal to a different location, is equally simple and requires only the lifting of the peg merchandise support frame 14 upwardly from the stick merchandise support frames 16, 18, 20, 22, 24 and 26 to an extent sufficient to clear the same, whereupon dis-assembly is in essence complete.

Figure 4:
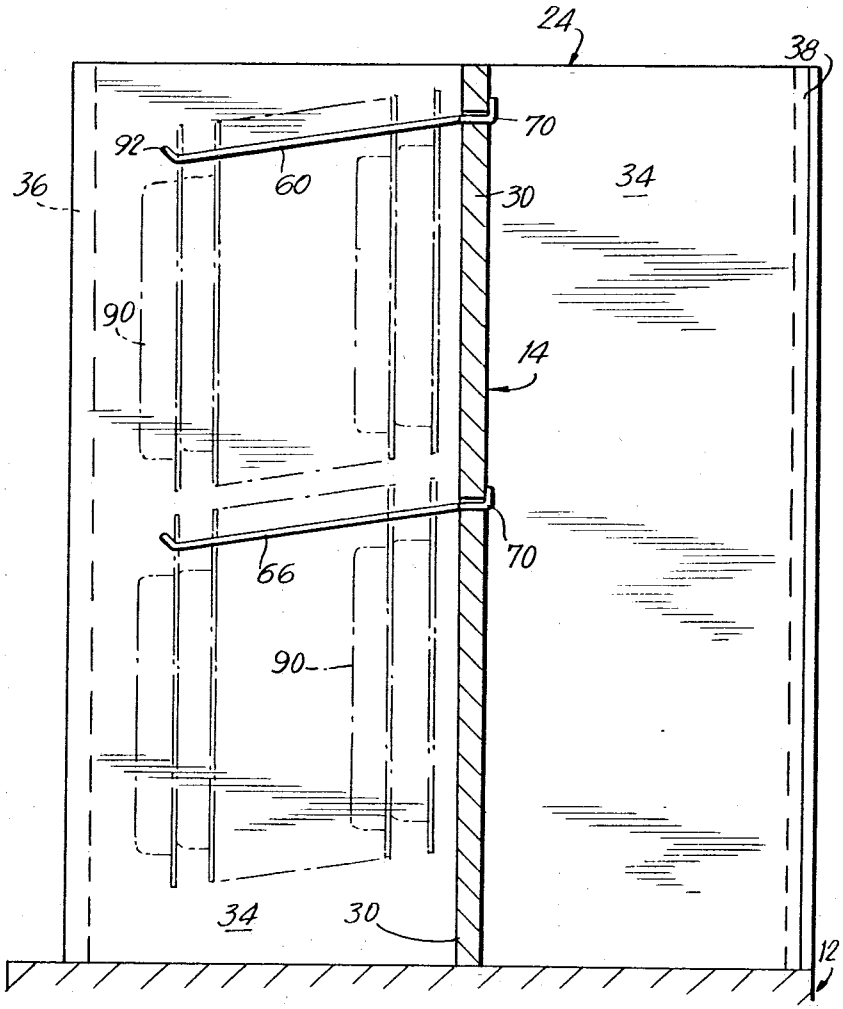
FIG. 4 is a vertical cross section taken along line 4—4 of FIG. 2.

Further included in the peg merchandise support frame 14 are spaced pairs of upper and lower merchandise support pegs which are supported from and extend forwardly of the frame 14 between the respective stick merchandise support frames to corresponding locations short of the front edges of the latter. Thus potentially damaging exposure of the peg end portions is prevented. More specifically, these support pegs which are best seen in FIGS. 2, 4 and 6 as indicated at 56, 58, 60, 62, 64, 66 and 68, respectively, each comprise a double pronged, hooked mounting end 70 which in each instance extends as shown through a pair of spaced mounting apertures provided therefor in the support frame 14 for the secure, yet readily removable, attachment of the peg to the frame. Significantly, and as best seen in FIG. 4 for merchandise support pegs 60 and 66, each of the support pegs is configured to extend from support frame 14 downwardly at an appropriate angle, for example 10°, below the horizontal; and it is this feature which provides for the automatic gravity feed of the peg merchandise as described in detail hereinbelow.

Further included in the stick merchandise support frames are vertical merchandise stop members as indicated at 72, 74, 76, 78 and 80 for stick merchandise support frames 20, 22, 24, 26 and 28. These vertical stop members each extend from the top of the front portion of the relevant support frame downwardly to a limited extent between the respective side walls thereof in the manner best seen for stop member 76 in stick merchandise support frame 32 in FIG. 4. Horizontal merchandise stop members are provided in alternating ones of the stick merchandise support frames as indicated at 82, 84 and 86 for support frames 20, 24 and 28 in FIG. 2; and, as best seen in FIGS. 2, 3 and 6 for stop member 84 in stick merchandise support frame 24, extend completely across the same from the front to the back of the fixture 10 at approximately the mid-point of the relevant support frame.

With the display fixture 10 of the invention configured and assembled as described, it will be clear that each of the stick merchandise support frames will provide front and rear stick merchandise display compartments to opposite sides of the peg merchandise support frame 14 as indicated generally at 81 and 83 for stick merchandise support frames 24 and 26 in FIG. 2. Correspondingly, each adjacent pair of the stick merchandise support frames taken in conjunction with the relevant portion of the peg merchandise support frame 14 and the relevant pair of merchandise support pegs, will provide a peg merchandise display compartment as indicated generally at 89 in FIG. 2 for the thusly provided compartment between stick merchandise support frames 24 and 26.

Stocking of the display fixture 10 of the invention with the peg and stick merchandise is simple and straight-forward. More specifically, it will be clear that the peg merchandise, i.e. mounting-apertured blister or otherwise packaged varieties of sponges, brushes, mop heads and the like as indicated in phantom at 90 in FIGS. 1, 2, 4 and 6 of the drawings, may be readily and conveniently hung for display from the support pegs in the respective display compartments by the simple expedient as shown in each instance of passing the package mounting aperture around the support peg and sliding the package backward toward the peg merchandise support frame 14 as seen in FIGS. 1 and 4 until all peg merchandise support space on all of the support pegs has been filled. The peg merchandise is retained on the downwardly sloping support pegs by the simple expedient of bending the forward ends of the latter upwardly as indicated at 92 for support peg 60 in FIG. 4.

Significantly, with this arrangement, the removal from a support peg of a piece of peg merchandise 90 for purchase by the consumer will result in the remaining piece or pieces of peg merchandise on that particular support peg automatically sliding forward under the influence of gravity to the forward-most position on the peg against peg end 92 in the manner made clear by FIG. 4. This insures that even if there is only one piece of peg merchandise 90 remaining on a particular support peg, the former will occupy the forwardmost, and thus the most readily visible and saleable, position thereon to very significant advantage as should be obvious to all skilled in this art. Further, and assuming that there is only one piece of peg merchandise 90 remaining on each of the pair of support pegs in a particular peg merchandise display compartment, for example the peg merchandise display compartment 89 as formed between side walls 34 and 40 of stick merchandise support frames 24 and 26, it will be clear that this gravity feed feature, taken in conjunction with the relatively close proximity of side walls 34 and 40 to the respective peg merchandise pieces under discussion, will nonetheless operate to maintain the well-stocked, attractive and sales-conducive appearance of that peg merchandise display compartment. Too, and although depending of course upon overall support peg length vis-a-vis peg merchandise package thickness, it should be clear that in most instances the peg merchandise support and display capacity of each of the support pegs should be quite sufficient to enable the display fixture 10 to in essence provide a warehousing function for the peg merchandise.

The stick merchandise, i.e. varieties of brooms and mops and like long-handled articles as indicated in phantom at 94 in FIGS. 1, 2, 3, 5 and 6 of the drawings, is simply placed handles-down as shown in the respective front and rear compartments 81 and 83 of the stick merchandise support frames 16, 18, 20, 22, 24 26 and 28 until all of the same are filled. Advantageously, the vertical merchandise stop members and the vertically oriented peg merchandise support frame 14 will, in conjunction with the respective stick merchandise support member end caps, function to maintain the stick merchandise 94 generally vertically oriented to present a neat and readily saleable appearance even after a goodly portion thereof has been removed from the display fixture 10 for sale; and this is believed made clear by FIG. 5 wherein the relevant relationship between end cap 44, vertical stop member 78, peg merchandise support member 14, end cap 46, and the stick merchandise 94 is illustrated for stick merchandise support member 26.

In addition, the use as described of the horizontal stick merchandise stop members 82, 84 and 86 in alternating ones, only, of the stick merchandise support frames provides for the vertically staggered display of the respective mop and broom heads of the stick merchandise 94 as made clear by FIG. 1 to prevent overlapping of the same. This insures that all of the same are fully visible, and thus displayed to full advantage to the consumer, thereby contributing further to the attractiveness and sales-effectiveness of the stick merchandise display. Too, and as the stick merchandise is removed for sale from the front compartments 81 of the stick merchandise support frames, it becomes a very simple matter for the store personnel to periodically move stick merchandise from the rear compartments 83 to the front compartments 81 to preserve the well-stocked appearance of the display fixture 10. Thus, the fact that the fixture 10 in essence also performs a merchandise warehousing function for the stick merchandise is made clear.

Referring again to FIG. 1, it will be seen that the merchandise display fixture of the inventory may be constructed in modular or sectional form to provide greater versatility for the display fixture vis-a-vis merchandise display applications having different overall merchandise quantity display requirements, and to render the shipping of the fixture components and fixture assembly more convenient. More specifically, in this form the peg merchandise support frame 14 may be seen to extend respectively to the left of stick merchandise support frame 16 and to the right of stick merchandise support frame 28 only approximately one-half the normal distance between stick merchandise support frames, and to then terminate in straight vertical edges as indicated at 100 and 102 in FIG. 1. Support peg mounting apertures 104, 106, 108 and 110 are formed as shown in these extended peg merchandise support frame portions. Additional merchandise display fixture sections are depicted in part in phantom at 112 and 114 in FIG. 1, and may be seen to respectively abut the respective vertical edges 100 and 102 of the peg merchandise support frame 14 of display fixture 10; and to comprise support peg mounting apertures 116, 118, 120 and 122 which respectively align with support peg mounting apertures 104, 106, 108 and 110 as shown to form the requisite support peg mounting aperture pairs in each instance. Thus, with the respective merchandise display fixture sections 112, 10 and 114 of the invention relatively positioned as shown in FIG. 1, it will be clear that a very large capacity overall merchandise display fixture may be provided. Of course, the positioning as described hereinabove of the double pronged, hooked mounting ends 70 of the support pegs in the thusly formed aligned pairs 116-104, 118-106, 120-108 and 122-110 of peg mounting apertures will advantageously function to insure that the merchandise display fixture sections 112, 10 and 114 are retained in the depicted firmly abutting positions thereof. In the event that this sectional or modular display fixture construction is not required, it will be clear that the same can be readily elininated by simply terminating the peg merchandise display frame in respective straight vertical edges just sufficiently to the left of stick merchandise support frame 16 and to the right of stick merchandise support frame 28 to insure the structural integrity of the interfitted joinder of those stick merchandise support frames with the peg merchandise support frame.

By all of the above is believed made clear that the new and improved merchandise display fixture of the invention will function in full accordance with the heretofore stated objects thereof to provide for particularly significant advancement in the art of merchandise display.

Although disclosed hereinabove by way of representative example as applied to the display of merchandise in the nature of brooms, mops, brushes, sponges and mop heads and the like, it will be clear that the merchandise display fixture of the invention is not limited to the display of that exact type of merchandise.

Various changes may of course be made in the herein-disclosed preferred embodiment of this invention without departing from the spirit and scope thereof as defined in the appended claims. Thus, for example, the base 12 may be eliminated and the display fixture 10 disposed directly on any suitably flat available mounting surface. Too, the location of the intersections between the peg merchandise support frame and the respective stick merchandise support frames which, as seen in FIG. 2, is somewhat to the rear of the mid-points of the latter, may be changed within reasonable limits with attendant change in the peg merchandise capacity of the display fixture 10. Of course, change of this nature would require corresponding change in support peg lengths.

What is claimed is:

1. Apparatus providing a display stand comprising a plurality of elements each mounting in a plane which extends substantially perpendicular to a base surface, a first portion of said elements being a double walled structure including longitudinally extending walls connected in a substantially parallel relatively closely spaced relation and constructed and arranged to mount a plurality of brooms, brushes, mops or other tools distinguished by a long handle for their operation, with their handles therebetween, a second portion of said elements being formed for the releasable mount thereto of "peg" type merchanidse, said first and second portions of said elements including means providing an interfit thereof and by means of said interfit per se an interconnection of said elements producing a free standing display structure without need for fasteners.

2. Apparatus as in claim 1 wherein said first portion of said elements has the configuration of a box like structure vertically oriented sides of which are provided by said longitudinally extending walls upper limts of which laterally bound an opeing at the top of said structure, said opening being so formed that the handles of a plurality of tools may be freely inserted and grouped within said box-like structure, along its length, and the distinguishing portions of said tools positioned outwardly thereof and thereabove.

3. Apparatus as in claim 1 wherein said second portion of said elements has the configuration of a sheet like wall structure, and a plurality of said double walled structures are interfit to and directly with said sheet-like structure to project therefrom and substantially perpendicular thereto at locations spaced longitudinally thereof.

4. Apparatus as in claim 1 wherein said first portion and said section portion of said elements have complementary slots which provide said means by which respective portions of said elements snugly interfit to produce said free standing display structure.

5. Apparatus as in claim 1 wherein said second portion of said elements is a wall structure, each of said first and said second portions of said elements has the vertical extent thereof, in part, intersected by a portion of the other, by means of said interfit thereof, one said portion of said elements intersecting a lower portion of the other and said other portion intersecting an upper portion of said one said portion of said elements to provide said interfit of said elements.

6. Apparatus as in claim 1 wherein said second portion of said elements has a wall-like configuration which is longitudinally extended and has parallel slots which are relatively spaced, one from the other, along the length thereof and vertically oriented and each said slot accommodates, with a snug fit, a portion of one of said first portion of said elements to produce thereby a multi-compartmented display structure wherein the products applied thereto may be displayed in an accessible but relatively protected environment.

7. Apparatus as in claim 1 wherein said first portion of said elements comprises a hollow longitudinally extending box-like structure open at the top and provided with stop means which serve as support and limit means defining the extent of projection of said tools through said opening at the top of said box-like structure and maintaining a generally vertical orientation of the handles of the tool or tools which are applied therein for display purposes.

8. Apparatus as in claim 1 wherein said first and said second portions of said elements are interfit to provide successively adjacent longitudinally spaced parallel wall structures which are transversely bridged by a further wall structure of which said second portion of said elements is comprised to form a display stand presenting back to back compartments the back wall of each of which is provided by a portion of said wall structure of which an element of said second portion of said elements is comprised.

9. A merchandise display stand particularly advantageous for use in the common display of "peg" and stick merchandise including a plurlaity of vertically oriented components engaged in an intersecting relation to mount on and extend vertically upward from a ground or base surface, a first portion of said components providing means for the support thereon of peg merchandise or the equivalent, a second portion of said components providing means for the support of stick merchandise or the equivalent, said first and second portions of said components each having the form of a longitudinally extending wall structure, said wall structures being interengaged by means of complementary slots, each accommodating a portion of an intersecting wall structure other than that in which the slot is formed, the width of said slots as related to the thickness of the portions of said wall structures which they respectively accommodate producing a snug and stabilizing interfit and interconnection of said components without need for fasteners and rendering said components readily and quickly separable and capable of quick reassembly as, when and where required.

10. Apparatus as in claim 9 wherein said second portion of said components comprises wall structures which are hollow, at least in part, and open at the top to receive and contain therein, in a grouped following relation, along the length thereof, at least portions of the handles of a plurality of brushes, brooms, mops, or other tools having long handles in a manner to establish the distinguishing portions of such tools immediately thereabove, the disposition, form and interrelation of such components being so arranged as to provide a merchandise display structure wherein the articles displayed are in an orderly, compartmented and relatively protected environment.

11. Apparatus as in claim 10 wherein said first portion of said components comprises an element in the form of a longitudinally extending wall structure having a sheet-like configuration and including therein a plurality of slots which are formed in a vertically oriented, essentially parallel, longitudinally spaced relation, each of said slots in said sheet-like wall structure is intersected by a portion of one of a plurality of said wall structures of which said second portion of said components is comprised in a manner to provide said display stand with a plurality of compartments including compartments at each of the opposite faces of said sheet-like wall structure the back wall of which is a portion of the length of said sheet-like wall structure and the sides of which are defined by parts of said wall structures of which said second portion of said components is comprised, each of the latter of which per se forms a compartment open at the top so constructed and arranged as to provide protective containment of portions of handles of stick merchandise and establish significant portions of such stick merchandise above the compartment, where the same may be observed in an accessible yet protective environment.

12. Apparatus as in claim 9 wherein said first and second portions of said components are so arranged in their intersected relation that each has a part of the length thereof project from and substantially perpendicular to each of the opposite faces of the wall structure which they intersect to provide thereby a display stand having distinct side by side and oppositely facing display segments within the limits of each of which one may mount and display, in a relatively small floor space, a multitude of small and large articles of the type described in a relatively protected and sheltered environment.

* * * * *

UNITED STATES PATENT AND TRADEMARK OFFICE

CERTIFICATE OF CORRECTION

PATENT NO. : 4,576,291

DATED : Mar. 18, 1986

INVENTOR(S) : Robert Stein

It is certified that error appears in the above-identified patent and that said Letters Patent is hereby corrected as shown below:

Column 9, line 57 (claim 1, line 12) correct "merchanidse" to read -- merchandise --.

Column 9, line 65 (claim 2, line 4) correct "limts" to read -- limits --.

Column 9, line 66 (claim 2, line 5) correct "opeing" to read -- opening --.

Column 10, line 12 (claim 4, line 2) correct "section" to read -- second --.

Column 10, line 56 (claim 9, line 3) correct "plurlaity" to read -- plurality --.

Signed and Sealed this

*Twenty-second* Day of *July 1986*

[SEAL]

*Attest:*

DONALD J. QUIGG

*Attesting Officer*

*Commissioner of Patents and Trademarks*